US005833489A

United States Patent [19]

Kim

[11] Patent Number: 5,833,489

[45] Date of Patent: Nov. 10, 1998

[54] ELECTRICAL PLUG

[75] Inventor: Young-Soon Kim, Incheon, Rep. of Korea

[73] Assignee: Daewoo Electronics Co., Ltd., Rep. of Korea

[21] Appl. No.: 766,208

[22] Filed: Dec. 12, 1996

[30] Foreign Application Priority Data

Dec. 29, 1995 [KR] Rep. of Korea ..... 95-65232

[51] Int. Cl.[6] ..... H01R 13/58

[52] U.S. Cl. ..... 439/456

[58] Field of Search ..... 439/456–459

[56] References Cited

U.S. PATENT DOCUMENTS

| | | | |
|---|---|---|---|
| 3,930,116 | 12/1975 | Richards | 439/456 |
| 4,191,444 | 3/1980 | Smith et al. | 339/107 |
| 4,842,544 | 6/1989 | Birch et al. | 439/387 |
| 5,110,306 | 5/1992 | Buck et al. | 439/497 |

FOREIGN PATENT DOCUMENTS

| | | | |
|---|---|---|---|
| 0162597 | 11/1985 | European Pat. Off. . | |
| 2256105 | 6/1974 | Germany | 439/456 |
| 96-9942 | 4/1996 | Rep. of Korea . | |
| 253221 | 6/1926 | United Kingdom . | |
| 323268 | 12/1929 | United Kingdom . | |
| 431428 | 7/1935 | United Kingdom . | |
| 588877 | 6/1947 | United Kingdom . | |

*Primary Examiner*—Gary F. Paumen

*Attorney, Agent, or Firm*—Cushman Darby & Cushman Intellectual Property Group of Pillsbury Madison & Sutro, LLP

[57] ABSTRACT

Disclosed is an electrical plug capable of preventing an overheating of electric wires of an electric cord connected to the electrical plug, and of preventing an accidental disconnection of the electric cord, thereby being very safe and very long-lasting. A plurality of plug terminals of the electrical plug are inserted into a wall outlet in order to supply an electric power to an electrical appliance. An electric cord electrically connects the electrical appliance to an electrical source. A first electric wire and a second electric wire are connected to the plug terminals, respectively. A plug body supports a connection between the plug terminals and the electric cord. Preferably, the plug body is made of a polyamide by using an injection molding process. A supporting portion for supporting the first electric wire and the second electric wire protrudes level to a center line of the main body and from one face of a main body of the plug body. A plurality of fixing members fix the first electric wire and the second electric wire on the supporting portion. A part of the fixing means has a reverse L-shape in order to effectively prevent the electric wires from shorting. Thereby, the first electric wire and the second electric wire do not short at the plug terminals.

6 Claims, 2 Drawing Sheets

ELECTRICAL PLUG

BACKGROUND OF THE INVENTION

1. Field of the Invention

The present invention relates to an electrical plug, and more particularly to an electrical plug capable of preventing an overheating of electric wires of an electric cord connected to the electrical plug, and of preventing an accidental disconnection of the electric cord, thereby being very safe and very long-lasting.

2. Description of the Prior Art

Generally, household electric appliances such as a vacuum cleaner, a hair dryer, an electric razor, and the like, or electric tools such as an electric drill, and the like, have a long cord extending from a main body of the household electric appliances in order to offer convenience to a user thereof.

However, when the user uses the household electric appliance/the electric tool, an unexpected external stress can be applied between the electric cord extending from the household electric appliance/the electric tool and the electrical plug attached to a distal end of the electric cord. That is, when the user uses the household electric appliance/the electric tool by inserting the electric plug into a wall outlet, it is possible to generate a great strain between the electric cord and the electrical plug due to a carelessness of the user or due to an external shock.

As a result, a cord breaking may occur between the electrical plug and the electric cord. Thereby, an operation of the household electric appliance/the electric tool may stop, and a fire caused by the short circuit may be generated. Further, the short circuit creates an electrical hazard for the user.

Meanwhile, if a user uses electric heaters such as an electric iron, an electric stove, and the like, or household electric appliances such as a coffee pot or a vacuum cleaner, and the like, for a long time, the amount of electric power consumed is highly increased. Accordingly, the electrical plug inserted into the wall outlet overheats. That is, electric wires in the electric cord, which are connected to the electrical plug under the state that one electric wire is disposed adjacent to the other electric wire, overheat. As a result, a fire may generate because of the overheating of the electric wires.

SUMMARY OF THE INVENTION

The present invention is contrived to solve the foregoing problems. It is an object of the present invention to provide an electrical plug capable of preventing an overheating of electric wires of an electric cord connected to the electrical plug, and of preventing an accidental disconnection of the electric cord, thereby being very safe and very long-lasting.

In order to achieve the above object, the present invention provides an electrical plug comprising:

a plurality of plug terminals for supplying an electric power to an electrical appliance, the plug terminals being inserted into a wall outlet, and the plug terminals including a first plug terminal and a second plug terminal;

an electric cord for transmitting the electric power from the plug terminals to the electrical appliance, the electric cord extending between the electrical appliance and the plug terminals, and the electric cord including a first electric wire, a second electric wire and a coating enclosing the first electric wire and the second electric wire; and a plug body for supporting a connection between the plug terminals and the electric cord, the plug body comprising a main body, comprising a supporting means for supporting the first electric wire connected to the first plug terminal and the second electric wire connected to the second plug terminal, comprising a plurality of first fixing means for preventing the first electric wire from shorting at the first plug terminal, and comprising a plurality of second fixing means for preventing the second electric wire from shorting at the second plug terminal, in which the first fixing means protrude from a first face of the supporting means, the second fixing means protrude from a second face of the supporting means, the supporting means protrudes from one face of the main body in a direction level to a center line of the main body, and the first electric wire and the second electric wire are kept separate from each other.

Preferably, the plug body is made of a polyamide by using an injection molding process. The plug body further comprises a plurality of plug terminal receiving portions for receiving the plug terminals. The plug terminal receiving portions are parallel to each other and protrude from both faces of the main body in a direction level to the center line of the main body, and include a through hole formed through respective interiors.

The first fixing means include a first fixing member protruding from a center of the first face, and a second fixing member and a third fixing member protruding at a position below the first fixing member with respect to the main body. The second fixing means include a fourth fixing member protruding from a center of the second face, and a fifth fixing member and a sixth fixing member formed in a horizontal line and protruding at a position below the fourth fixing member with respect to the main body.

The first fixing member and the fourth fixing member have a cylindrical shape respectively, and the second fixing member, the third fixing member, the fifth fixing member and the sixth fixing member have a reverse L-shape, respectively.

As described above, in the electrical plug according to a preferred embodiment of the present invention, the first electric wire is fixed to the first face of the supporting means and the second electric wire is fixed to the second face of the supporting means. Therefore, although a user uses the electrical appliance having the electrical plug for a long time, the first electric wire and the second electric wire do not overheat. Accordingly, a fire due to the overheating of the electric wires can be prevented.

Further, the first electric wire and the second electric wire are firmly fixed on the supporting means by using the reverse L-shaped fixing members. Therefore, it is possible to effectively prevent the electric wires of the electric cord from shorting at the plug terminals of the electrical plug due to a shock applied to the electric cord during the use of the electrical appliance.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the preferred embodiment of the present invention will be explained in more detail with reference to the accompanying drawings.

FIGS. 1 to 4B illustrate an electrical plug 100 according to a preferred embodiment of the present invention.

Figure 1:
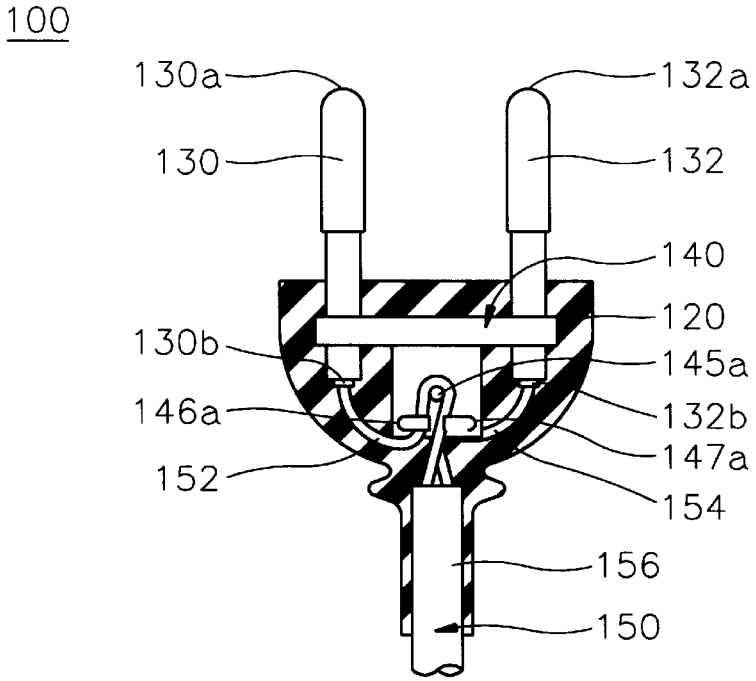
FIG. 1 is a longitudinal sectional view of an electrical plug according to a preferred embodiment of the present invention, for showing a state where a first wire is connected to a first plug terminal.
Figure 2:
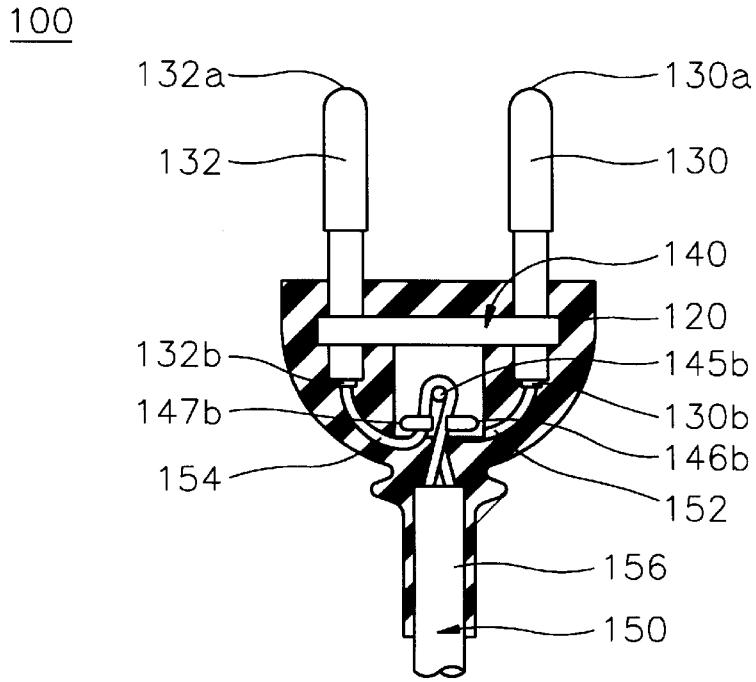
FIG. 2 is a longitudinal sectional view of the electrical plug according to the preferred embodiment of the present invention, for showing a state where a second wire is connected to a second plug terminal.

First, referring to FIG. 1 and FIG. 2, electrical plug 100 includes a plug seat 120, a first plug terminal 130, a second plug terminal 132, a plug body 140 and an electric cord 150.

Plug seat 120 is made of an incombustible plastic. Plug seat 120 encloses first plug terminal 130, second plug terminal 132, plug body 140 and a part of electric cord 150.

First plug terminal 130 and second plug terminal 132 are made of a metal having excellent electric conductivity. When first plug terminal 130 and second plug terminal 132 are inserted into a wall outlet (not shown) by a user of the household appliance, an electric current for operating a household appliance (not shown) having electrical plug 100 is supplied from an outer electric source to the household appliance. First plug terminal 130 and second plug terminal 132 have a first front end 130*a* and a second front end 132*a* respectively, which are curved in order to easily inserted into the wall outlet.

Electric cord 150 includes a first electric wire 152, a second electric wire 154 and an insulating coating 156 enclosing first electric wire 152 and second electric wire 154. First electric wire 152 and second electric wire 154 are made of made of a metal having excellent electric conductivity. First electric wire 152 is connected to a first rear end 130*b* of first plug terminal 130. Second electric wire 154 is connected to a second rear end 132*b* of second plug terminal 132. First electric wire 152 and second electric wire 154 are fixed to and supported by plug body 140.

Figure 3:
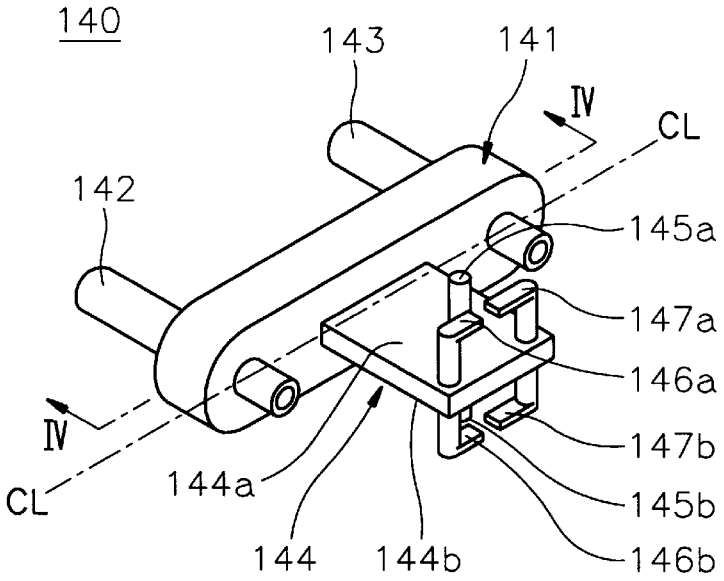
FIG. 3 is an enlarged perspective view of a plug body illustrated in FIGS. 1 and 2.
Figure 4A:
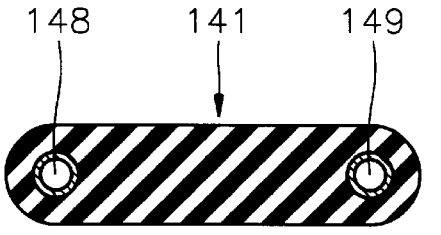
FIG. 4A is a cross-sectional view taken along line IV–IV shown in FIG. 3.
Figure 4B:
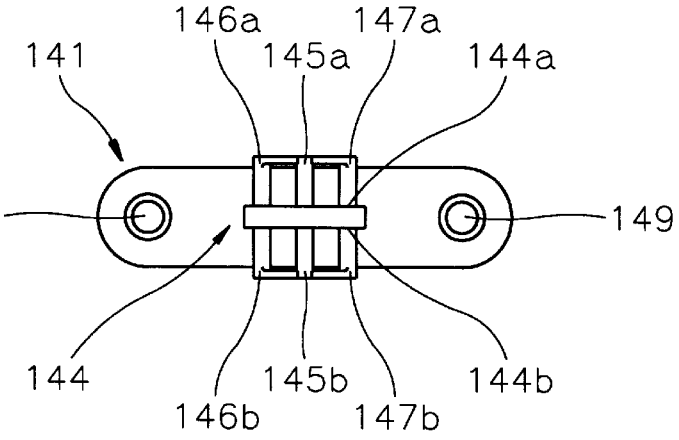
FIG. 4B is a front view of the plug body illustrated in FIG. 3.

FIGS. 3, 4A and 4B illustrate plug body 140 in detail. Preferably, plug body 140 is made of a polyamide by using an injection molding process. Plug body 140 includes a main body 141, a first plug terminal receiving portion 142, a second plug terminal receiving portion 143 and a square-shaped flat supporting portion 144. Further, plug body 140 includes a first fixing portion 160 for fixing first electric wire 152, and a second fixing portion 170 for fixing second electric wire 154. First fixing portion 160 includes a first fixing member 145*a*, a second fixing member 146*a* and a third fixing member 147*a*. Second fixing portion 170 includes a fourth fixing member 145*b*, a fifth fixing member 146*b* and a sixth fixing member 147*b*.

First plug terminal receiving portion 142 and second plug terminal receiving portion 143 are parallel to each other and protrude from both faces of main body 141. As illustrated in FIG. 4A and 4B, first plug terminal receiving portion 142 and second plug terminal receiving portion 144 include a first through hole 148 and a second through hole 149, respectively.

First plug terminal receiving portion 142 and second plug terminal receiving portion 143 receive first plug terminal 130 and second plug terminal 132, respectively. That is, first plug terminal 130 is inserted into first through hole 148 of first plug terminal receiving portion 142 so that first front end 130*a* and first rear end 130*b* are exposed. Similarly, second plug terminal 132 is inserted into second through hole 149 of second plug terminal receiving portion 143 so that second front end 132*a* and second rear end 132*b* are exposed.

Supporting member 144 supports first electric wire 152 and second electric wire 154 while first electric wire 152 is kept separated from second electric wire 154. Supporting member 144 extends level to a center line (CL) of main body 141 and from main body 141 in the backward direction with respect to main body 141, between first plug terminal receiving portion 142 and second plug terminal receiving portion 143.

First fixing portion 160, which includes a first fixing member 145*a*, a second fixing member 146*a* and a third fixing member 147*a*, protrudes from on an upper face 144*a* of a supporting portion 144 in the upward direction. First fixing member 145*a* has a cylindrical shape and is formed at a center of upper face 144*a*. Second fixing member 146*a* and third fixing member 147*a* have reverse L-shape and are formed in a horizontal line and below first fixing member 145*a* with respect to main body 141. First fixing member 145*a*, second fixing member 146*a* and third fixing member 147*a* firmly fix first electric wire 152 on support portion 144 when first electric wire 152 is connected to electrical plug 100.

Second fixing portion 170, which includes a fourth fixing member 145*b*, a fifth fixing member 146*b* and a sixth fixing member 147*b*, protrude from a lower face 144*b* of supporting portion 144 in the downward direction. Fourth fixing member 145*b* has a cylindrical shape and is formed at a center of lower face 144*b*. Fifth fixing member 146*b* and sixth fixing member 147*b* have reverse L-shape and are formed in a horizontal line and below fourth fixing member 145*b* with respect to main body 141. Fourth fixing member 145*b*, fifth fixing member 146*b* and sixth fixing member 147*b* firmly fix second electric wire 154 on support portion 144 when second electric wire 154 is connected to electrical plug 100.

Hereinbelow, a method for connecting first electric wire 152 and second electric wire 154 to first plug terminal 130 and second plug terminal 132 respectively, in electrical plug 100 according to the preferred embodiment of the present invention and constituted as described above will be briefly described.

First, first plug terminal 130 is inserted into first plug terminal receiving portion 142 so that first front end 130*a* and first rear end 130*b* of first plug terminal 130 are exposed. Similarly, second plug terminal 132 is inserted into second plug terminal receiving portion 143 so that second front end 132*a* and second rear end 132*b* of second plug terminal 132 are exposed.

Thereafter, first electric wire 152 and second electric wire 154 of electric cord 150 are connected to first rear end 130*b* of first plug terminal 130 and second rear end 132*b* of second plug terminal 132, respectively. In other words, first electric wire 152 and second electric wire 154 are inserted into inserting holes (not shown) formed in first rear end 130*b* and second rear end 132*b*, respectively.

Then, first electric wire 152 and first rear end 130*b* are connected by using a heat compression process. Accordingly, first electric wire 152 is electrically connected to first plug terminal 130. Similarly, second electric wire 154 and second rear end 132*b* are connected by using a heat compression process. Accordingly, second electric wire 154 is electrically connected to second plug terminal 130. Thereby, an electrical connection between electrical plug 100 and electric cord 150 is completed.

When the electrical connection between electrical plug 100 and electric cord 150 is completed, first electric wire 152 is firmly fixed on upper face 144*a* of supporting member 144 by first fixing member 145*a*, second fixing member 146*a* and third fixing member 147*a*, and second electric wire 154 is firmly fixed on lower face 144*b* of supporting member 144 by fourth fixing member 145*b*, fifth fixing member 146*b* and sixth fixing member 147*b*.

Referring to FIG. 1, on upper face 144*a* of supporting portion 144, first electric wire 152 is wrapped around first fixing member 145*a*' in the counter-clockwise direction and is wrapped around second fixing member 146*a* in the clockwise direction. At this time, second fixing member 146*a* having a reverse L-shape and third fixing member 147*a* having a reverse L-shape prevent first electric wire 152 from being released from upper face 144*a* of supporting portion 144.

Referring to FIG. 2, on lower face 144*b* of supporting portion 144, second electric wire 154 is wrapped around fifth fixing member 145*b* in the counter-clockwise direction and is wrapped around seventh fixing member 147*b* in the clockwise direction. At this time, sixth fixing member 146*b* having a reverse L-shape and seventh fixing member 147*b* having a reverse L-shape prevent second electric wire 154 from being released from lower face 144*b* of supporting portion 144.

As described above, in electrical plug 100 according to the preferred embodiment of the present invention, first electric wire 152 is fixed on upper face 144*a* of supporting portion 144 and second electric wire 154 is fixed on lower face 144*b* of supporting portion 144. Therefore, although a user uses the electrical appliance having electrical plug 100 for a long time, first electric wire 152 and second electric wire 154 do not overheat. Accordingly, a fire due to the overheating of the electric wires can be prevented.

Further, first electric wire 152 and second electric wire 154 are firmly fixed on supporting portion 144 by using the reverse L-shape fixing members. Therefore, it is possible to effectively prevent the electric wires of the electric cord from shorting at the plug terminals of the electrical plug 100 due to a shock applied to the electric cord during the use of the electrical appliance. Accordingly, electrical plug 100 according to the present invention is very safe and long-lasting.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An electrical plug comprising:

a plurality of plug terminals for supplying electric power to an electrical appliance, said plug terminals being inserted into a wall outlet, and said plug terminals including a first plug terminal and a second plug terminal;

an electric cord for transmitting electric power from said plug terminals to the electrical appliance, said electric cord extending between the electrical appliance and said plug terminals, and said electric cord including a first electric wire, a second electric wire and coating enclosing said first electric wire and said electric wire; and a plug body for supporting a connection between said plug terminals and said electric cord, said plug body comprising a main body, comprising a supporting means for supporting said first electric wire connected to said first plug terminal and said second electric connected to said second plug terminal, comprising a plurality of first fixing means for preventing said first electric wire from shorting at said first plug terminal, and comprising plurality of second fixing means for preventing said second electric wire from shorting at said second plug terminal, wherein said first fixing means protrude from a first face of said supporting means, said second fixing means protrude from a second face of said supporting means, said supporting means protrudes from one face of said main body in a direction level to a center line of said main body, and said first electric wire and said second electric wire are kept separate from each other, wherein said first fixing means include a first fixing member protruding from a center of the first face, and a second fixing member and a third fixing member protruding at a position below said first fixing member with respect to said main body, and wherein said second fixing means include a fourth fixing member protruding from a center of the second face, and a fifth fixing member and a sixth fixing member formed in a horizontal line and protruding at a position below said fourth fixing member with respect to said main body.

2. An electrical plug as claimed in claim 1, wherein said plug body further comprises a plurality of plug terminal receiving portions for receiving said plug terminals.

3. An electrical plug as claimed in claim 1, wherein said plug terminal receiving portions are parallel to each other and protrude from both faces of said main body in a direction level to the center line of said main body, and include a through hole formed through respective interiors.

4. An electrical plug as claimed in claim 1, wherein said first fixing member and said fourth fixing member have a cylindrical shape respectively, and said second fixing member, said third fixing member, said fifth fixing member and said sixth fixing member have a reverse L-shape, respectively.

5. An electrical plug as claimed in claim 1, wherein said plug body is made of a polyamide by using an injection molding process.

6. An electrical plug comprising:

(a) a plurality of plug terminals for supplying an electric power to an electrical appliance, said plug terminals being inserted into a wall outlet, and said plug terminals including a first plug terminal and a second plug terminal;

(b) an electric cord for transmitting the electric power from said plug terminals to the electrical appliance, said electric cord extending between the electrical appliance and said plug terminals, and said electric cord including a first electric wire, a second electric wire and a coating enclosing said first electric wire and said second electric wire; and (c) a plug body for supporting a connection between said plug terminals and said electric cord, said plug body being made of a polyamide by using an injection molding process, said plug body comprising a main body, comprising a supporting means for supporting said first electric wire connected to said first plug terminal and said second electric wire connected to said second plug terminal, comprising a plurality of first fixing means for preventing said first electric wire from shorting at said first plug terminal, comprising a plurality of second fixing means for preventing said second electric wire from shorting at said second plug terminal, and comprising a plurality of plug terminal receiving portions for receiving said plug terminals, in which said first fixing means protrude from a first face of said supporting means, said second fixing means protrude from a second face of said supporting means, said supporting means protrudes from one face of said main body in a direction level to a center line of said main body, and said first electric wire and said second electric wire are kept separate from each other, said plug terminal receiving portions are parallel to each other and protrude from both faces of said main body in a direction level to the center line of said main body, and said plug terminal receiving portions include a through hole formed through respective interiors, said first fixing means include a first fixing member protruding from a center of the first face, and a second fixing member and a third fixing member protruding at a position below said first fixing member with respect to said main body, said second fixing means include a fourth fixing member protruding from a center of the second face, and a fifth fixing member and a sixth fixing member formed in a horizontal line and protruding at a position below said fourth fixing member with respect to said main body, said first fixing member and said fourth fixing member have a cylindrical shape respectively, and said second fixing member, said third fixing member, said fifth fixing member and said sixth fixing member have a reverse L-shape, respectively.

* * * * *